US011075069B2

(12) United States Patent
Xiao et al.

(10) Patent No.: US 11,075,069 B2
(45) Date of Patent: Jul. 27, 2021

(54) OCTA-ELECTRODE LINEAR ION TRAP MASS ANALYZER

(71) Applicant: SHANGHAI YUDA INDUSTRIAL CO., LTD., Shanghai (CN)

(72) Inventors: Yu Xiao, Shanghai (CN); Rujiao Yao, Shanghai (CN); Xiaojun Qi, Shanghai (CN); Jian Jiang, Shanghai (CN); Yongyong Zhu, Shanghai (CN)

(73) Assignee: SHANGHAI YUDA INDUSTRIAL CO., LTD., Shanghai (CN)

( * ) Notice: Subject to any disclaimer, the term of this patent is extended or adjusted under 35 U.S.C. 154(b) by 0 days.

(21) Appl. No.: 16/765,481

(22) PCT Filed: Aug. 3, 2018

(86) PCT No.: PCT/CN2018/098477

§ 371 (c)(1),
(2) Date: May 20, 2020

(87) PCT Pub. No.: WO2019/095727

PCT Pub. Date: May 23, 2019

(65) Prior Publication Data

US 2020/0294783 A1 Sep. 17, 2020

(30) Foreign Application Priority Data

Nov. 20, 2017 (CN) ..... 201711157892.6

(51) Int. Cl.
*H01J 49/42* (2006.01)

(52) U.S. Cl.
CPC ..... *H01J 49/4225* (2013.01); *H01J 49/423* (2013.01)

(58) Field of Classification Search
CPC ..... H01J 49/42; H01J 49/422; H01J 49/4225; H01J 49/423
See application file for complete search history.

(56) References Cited

U.S. PATENT DOCUMENTS 7,019,290 B2 * 3/2006 Hager ..... H01J 49/067 250/282
9,000,362 B2 * 4/2015 Stoermer ..... H01J 49/0045 250/292

(Continued)

FOREIGN PATENT DOCUMENTS

CN 1788327 A 6/2006
CN 102231356 A 11/2011

(Continued)

*Primary Examiner* — David E Smith
(74) *Attorney, Agent, or Firm* — Bayramoglu Law Offices LLC

(57) ABSTRACT

An octa-electrode linear ion trap mass analyzer is formed by eight cylindrical electrodes and at least two end-cap electrodes. The inside surfaces of the eight cylindrical electrodes are free-form. The material of the octa-electrode linear ion trap mass analyzer is a conductive metal material or an insulating material plated with a conductive coating. The eight cylindrical electrodes are divided into four groups of cylindrical electrodes in total, each group of the four groups of cylindrical electrodes comprises two cylindrical electrodes, and each two groups of the four groups of cylindrical electrodes are parallelly placed. At least one through hole is provided with in the center of the end-cap electrode, and the two end-cap electrodes are respectively arranged at both ends of the cylindrical electrode.

3 Claims, 3 Drawing Sheets

(56) References Cited

U.S. PATENT DOCUMENTS

| | | | | |
|---|---|---|---|---|
| 9,805,923 | B2 * | 10/2017 | Goodwin | H01J 49/0031 |
| 2005/0258362 | A1 * | 11/2005 | Collings | H01J 49/4225 250/290 |
| 2006/0016979 | A1 | 1/2006 | Yang et al. | |
| 2009/0140141 | A1 * | 6/2009 | Hansen | H01J 49/4225 250/292 |
| 2009/0321624 | A1 * | 12/2009 | Fang | H01J 49/422 250/281 |
| 2011/0240849 | A1 * | 10/2011 | Wright | H01J 49/421 250/288 |
| 2011/0284741 | A1 * | 11/2011 | Stoermer | H01J 49/0072 250/292 |
| 2012/0248307 | A1 * | 10/2012 | Ding | H01J 49/423 250/293 |

FOREIGN PATENT DOCUMENTS

| | | | |
|---|---|---|---|
| CN | 103166330 | A | 6/2013 |
| CN | 104681392 | A | 6/2015 |
| CN | 105428201 | A | 3/2016 |
| CN | 205140928 | U | 4/2016 |
| CN | 105609400 | A | 5/2016 |
| CN | 105957798 | A | 9/2016 |
| CN | 206210749 | U | 5/2017 |
| CN | 108183061 | A | 6/2018 |

* cited by examiner

OCTA-ELECTRODE LINEAR ION TRAP MASS ANALYZER

CROSS REFERENCE TO THE RELATED APPLICATIONS

This application is the national phase entry of International Application No. PCT/CN2018/098477, filed on Aug. 3, 2018, which is based upon and claims priority to Chinese Patent Application No. 201711157892.6, filed on Nov. 20, 2017, the entire contents of which are incorporated herein by reference.

TECHNICAL FIELD

The present disclosure relates to a mass analyzer, in particular to an octa-electrode linear ion trap mass analyzer.

BACKGROUND

As one of the important instruments in modern analysis systems, mass spectrometer is a high-sensitivity and high-resolution instrument for detecting chemical composition of substances, and is widely used in various measurements, including the amino acid sequence of protein molecules, the metabolic process of drug molecules in vivo, protein-protein interaction and molecular dynamics process for protein folding. Furthermore, mass spectrometer is used as one of the main analytical tools in the fields of chemical analysis, food safety, pharmaceuticals, environmental monitoring, explosives monitoring, etc.

Mass analyzer is the core component of the mass spectrometer and impinges on the analytical performance of the mass spectrometer. The various types of mass spectrometers with different mass analyzers separate the irons according to the mass-to-charge ratio thereof in different ways. At present, the commonly used mass analyzers include Magnetic Sector Mass Analyzer (magnetic sector), Time-of-flight Mass Analyzer (TOF), Quadrupole Mass Filter (QMF), Ion Trap Mass Analyzer (Ion Trap), Fourier Transform Ion Cyclotron Resonance (FT-ICR) and Orbit Ion Trap Mass Analyzer (Orbitrap), etc. Among the commonly used mass analyzers, the ion trap mass analyzer has the advantages of a simple structure, low vacuum requirements, and multi-stage tandem mass spectrometry analysis, which shows unique technical superiority. Traditional ion trap mass analyzers are classified into three-dimensional ion traps and linear ion traps. The linear ion trap (LIT) has high ion trapping efficiency and ion storage efficiency, which can largely avoid space-charge effect. In view of the current prospect for research of mass spectrometry instruments and the demand for miniaturization, portability, high-throughput analysis methods and independent intellectual property rights, the linear ion traps have become an active area in the research field.

The traditional linear ion trap is composed of six electrodes, including two planar end-cap electrodes and four hyperboloid cylindrical electrodes. The hyperboloid structure requires an extremely high machining accuracy and assembling accuracy, generally requiring machining tolerances within a few microns, which brings a high machining cost. Thus, the ion trap mass spectrometer currently available on the market is expensive and it is difficult to spread and popularize the ion trap mass spectrometer. In recent years, the development of miniaturized and inexpensive ion trap mass spectrometers has become promising in the field of mass spectrometry, and therefore more linear ion traps with simplified electrode structures have emerged. The rectangular ion trap (RIT) proposed by Cooks et al. combines the advantages of a simple structure of the cylindrical ion trap (CIT) and a high storage capacity of the linear ion trap (LIT). The rectangular ion trap is formed by only six surrounding planar electrodes rather than the traditional hyperboloid electrodes, which simplify the machining and assembly process. Due to the simple structure and excellent analytical performance of the rectangular ion trap, the rectangular ion trap has become the first choice for mass analyzers in miniaturized mass spectrometers, and has been successfully applied in the production of small desktop mass spectrometers and portable mass spectrometers. The Printed Circuit Board rectangular ion trap mass analyzer (PCB ion trap) with a composite electrode structure reported by Ding et al. is formed by arranging two planar end-cap electrodes and four specially made PCB boards around, resulting in a high mass resolution, a large mass range, a simple structure, a low price, and a mature machining technology and method. Li et al. reported the PCB array ion trap on the basis of the PCB ion trap, including multiple ion mass analysis channels. Each mass analysis channel has functions such as ion storage and mass analysis, which satisfies the requirements for a high-throughput mass spectrometer in the current analysis field. Xiao et al. reported a new type of linear ion trap with a triangular trap electrode structure, consisting of four triangular cylindrical electrodes and two planar electrodes, all of which are planar electrodes, with good ion storage and mass analysis capabilities. When the scanning speed is 1307 Th/s, the ion mass resolution with m/z of 609 Th can reach 1500.

Although the above new linear ion trap simplifies the electrode structure, the high-order field components introduced by the simplified electrode will have a great impact on the performance of the mass analyzer. In addition, it is inevitable to form an ion ejection slot on the electrode in the ejection direction, which is another important factor in affecting the analysis performance of the linear ion trap. The ion ejection slot destroys the integrity of the entire electrode and introduces nonlinear high-order field components into the internal electric field, thereby posing distortion of the quadrupole field in the trap, and reducing the analytical performance of the linear ion trap. Moreover, the four-electrode traditional structure limits the flexibility and diversity of ways to apply the Radio frequency (RF) voltage, making it difficult to optimize the analytical performance of the linear ion trap by optimizing the RF voltage application mode.

SUMMARY

To solve the above technical problem, the present disclosure aims to provide an octa-electrode linear ion trap mass analyzer.

According to one aspect of the present disclosure, an octa-electrode linear ion trap mass analyzer is provided, wherein the octa-electrode linear ion trap mass analyzer is formed by eight cylindrical electrodes and at least two end-cap electrodes, wherein inside surfaces of the eight cylindrical electrodes are free-form, a material of the octa-electrode linear ion trap mass analyzer is a conductive metal material or an insulating material plated with a conductive coating, each two cylindrical electrodes form a group, thereby forming four groups of cylindrical electrodes in total, with each two of them parallelly placed; at least one through hole is provided in the center of the end-cap electrode, and the two end-cap electrodes are respectively arranged at both ends of the cylindrical electrode.

Preferably, the octa-electrode linear ion trap mass analyzer adjusts an electric field distribution in a space surrounded by the eight cylindrical electrodes, by changing a length, width and height of the eight cylindrical electrodes, the shapes of the inside surfaces of the eight cylindrical electrodes, a relative position among the four groups of cylindrical electrodes and a voltage application mode.

Preferably, there is a slit between at least one of the four groups of cylindrical electrodes, and a width of the slit between each group of two cylindrical electrodes is adjustable as desired.

Preferably, the end-cap electrode is applied with a DC signal to form an axial bound field, and the cylindrical electrode is applied with a radio frequency voltage to form a radial bound field.

Preferably, when the number of the end-cap electrodes is more than two, one of them is located at one end of a linear ion trap from which ions are injected, and the rest are arranged in order at the other end of the linear ion trap.

Compared with the prior art, the present disclosure brings the following advantages: first, the traditional four-electrode structure is replaced by an octa-electrode structure, so that the application mode of the working voltage is more flexible and diverse, meanwhile more new functions can be achieved; second, a whole piece of electrode is turned into two discrete electrodes, which weakens the adverse effects caused by the ion ejection slot. Further, the electric field distribution in the trap is optimized by adjusting the distance between each group of electrodes and optimizing the voltage application mode.

BRIEF DESCRIPTION OF THE DRAWINGS

In order to illuminate other features, objects, and advantages of the present disclosure, the non-limiting embodiments is described in detail with reference to the following drawings.

DETAILED DESCRIPTION OF THE EMBODIMENTS

The present disclosure will be specifically described hereinafter with reference to specific embodiments. The following embodiments are described for facilitating those skilled in the art to further understand the present disclosure, but do not intend to limit the present disclosure in any way. It should be noted that, for those of ordinary skill in the art, several variations and improvements can be made without departing from the concept of the present disclosure, all of which belong to the protection scope of the present disclosure.

Figure 5:
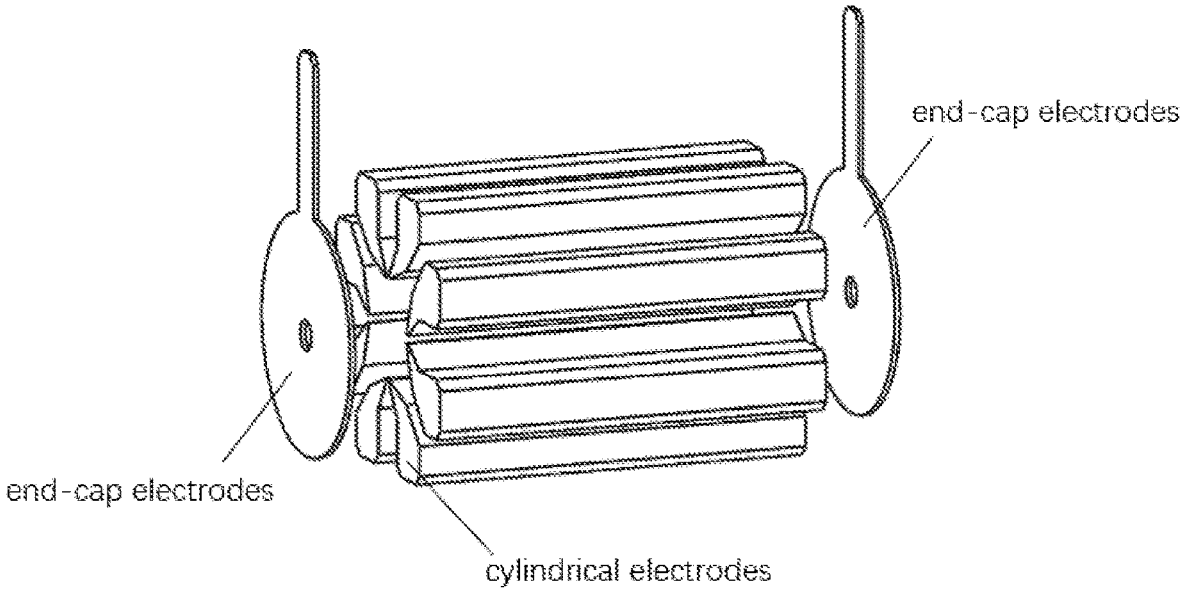
FIG. 5 is a perspective view of the present disclosure showing eight cylindrical electrodes and two end-cap electrodes.

As shown in FIG. 5, the octa-electrode linear ion trap mass analyzer of the present disclosure is formed by eight cylindrical electrodes and at least two end-cap electrodes, wherein the inner surface of the eight cylindrical electrodes is free-form, including circular arc, triangle, hyperboloid, etc., and the eight cylindrical electrodes are made of a conductive metal material or an insulating material plated with a conductive coating. The eight cylindrical electrodes can be identical or different. Each two cylindrical electrodes form a group, resulting in a total of four groups, with each two of them placed in parallel. The shape and size of at least two end-cap electrodes are not limited, including any polygonal shape such as a circle, square, hexagon, etc. The at least one end-cap electrode is provided with at least one through hole in the center, and the size and shape of the through hole not limited, including circle, square, hexagon, and other polygonal shapes. The surface of the end-cap electrode is flat, conical, arc or hyperboloidal. The two end-cap electrodes are arranged on the two ends of the cylindrical electrodes.

Among them, the length, width and height of the eight cylindrical electrodes are adjustable, that is, the electric field distribution in the space surrounded by the eight cylindrical electrodes is adjusted by changing the length, width and height of the eight cylindrical electrodes, the inner surface shape of the eight cylindrical electrodes, the relative position among the four groups of cylindrical electrodes and the voltage application mode, thereby obtaining a good ion storage and mass analysis performance.

There is a slit between at least one of the four groups of cylindrical electrodes, and the width of the slit between the two cylindrical electrodes of each group can be adjusted as desired. The width of the slits can be identical or different. The relative positions of the four groups of cylindrical electrodes are independently adjustable.

The end-cap electrode is applied with a DC signal to form an axial bound field, and the cylindrical electrode is applied with a RF voltage to form a radial bound field. The RF signal applied to each group of two cylindrical electrodes may be identical or different, which is settable depending on the actual expected effect. The application mode of the radio frequency voltage is arbitrary. The RF signals applied to the two cylindrical electrodes of each group may be identical or different, and the RF signals applied to the four groups of electrodes may be identical or different.

When the number of end-cap electrodes is more than two, one of them is located at one end of the linear ion trap for ion injection, and the rest are sequentially arranged at the other end of the linear ion trap.

The First Embodiment

Figure 1:
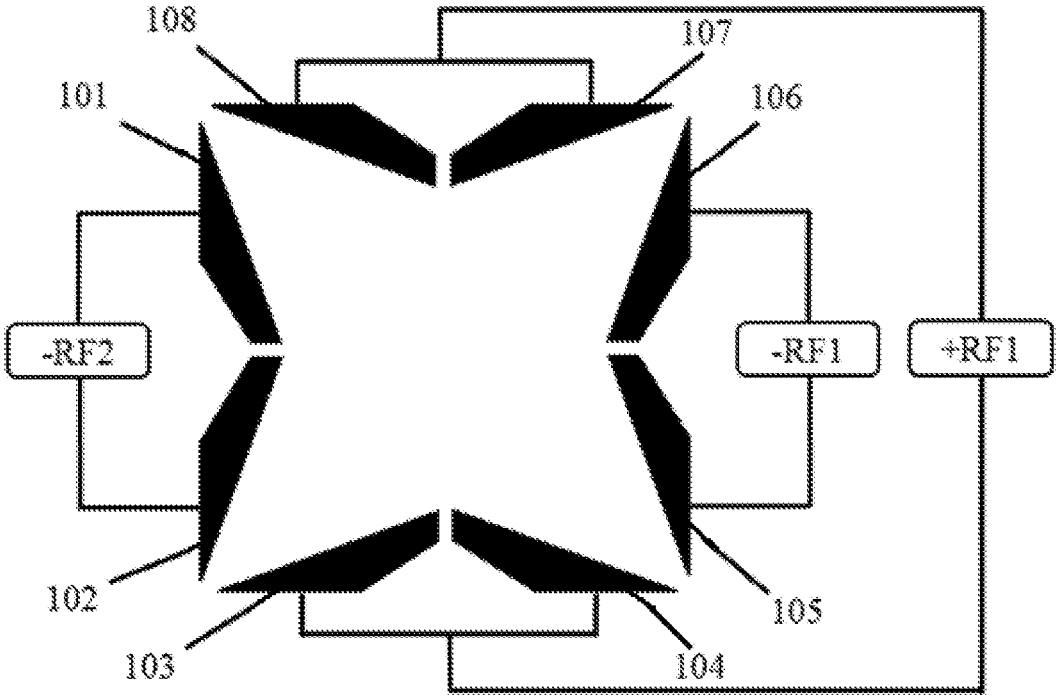
FIG. 1 is a schematic structural diagram of the first embodiment of the present disclosure.

The structure of the octa-electrode linear ion trap mass analyzer of the present disclosure is shown in FIG. 1. The first electrode 101, the second electrode 102, the third electrode 103, the fourth electrode 104, the fifth electrode 105, the sixth electrode 106, the seventh electrode 107, and the eighth electrode 108 are triangular electrodes, the entire linear ion trap is formed of eight surrounding triangular electrodes, and the application mode of the RF voltage is shown in FIG.1. The specific application mode of the radio frequency voltage is as follows: the first positive radio frequency signal +RF1 is applied to the third electrode 103, the fourth electrode 104, the seventh electrode 107, and the eighth electrode 108; the first negative radio frequency signal −RF1 of an equal amplitude and opposite phase is applied to the fifth electrode 105 and the sixth electrode 106;

and the second negative radio frequency signal −RF2 is applied to the first electrode 101 and the second electrode 102. During the experiment, by means of changing the amplitude of the second negative radio frequency signal −RF2, the electric field distribution inside the ion trap can be changed, thereby affecting the moving trajectory and ejection direction of ions. In this embodiment, an octa-electrode triangular linear ion trap mass analyzer will be used to realize the unidirectional ejection of ions, so as to improve the efficiency of ion detection for the linear ion trap under the single detector mode. Assuming −RF2=(1−α) RF1, where the range of parameter α is [0, 1]. As the value of a changes, the ratio of the RF voltage applied to the first electrode 101 and the second electrode 102 changes, while the magnitude of the RF voltage applied to the other three groups of electrodes remains unchanged, and meanwhile, the proportion of multipole field components such as the quadrupole field and the hexapole field, etc. in the internal electric field changes, and the center of the quadrupole field inside the ion trap shifts. During the movement of ions in the trap, under the electric field force, the ions will move in a direction which is consistent with the direction of the electric field center shift, and finally achieve unidirectional ejection.

In this embodiment, set the alpha value to 30%, that is −RF2=70% RF1, the center of the electric field will be biased toward the electrode to which a smaller voltage is applied, that is, a direction closer to the first electrode 101 and the second electrode 102. The center of motion of the ion is shifted, and the unidirectional ejection of ions is finally achieved.

Figure 2:
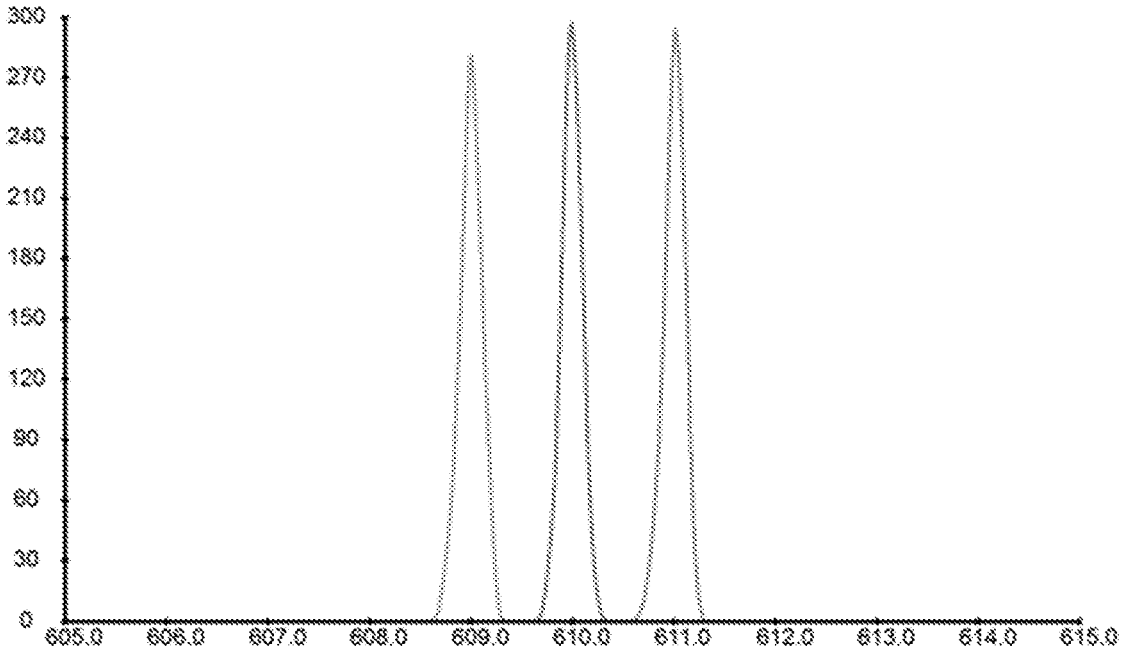
FIG. 2 is a schematic diagram of simulated mass spectrum peaks obtained when an octa-electrode triangular linear ion trap performs unidirectional ion ejection in the first embodiment.

In this embodiment, by means of theoretical simulation, the octa-electrode triangular linear ion trap mass analyzer is used to realize the unidirectional ejection function of the ion trap, and the simulated mass spectrum peak generated therefrom is studied to analyze the performance thereof. Three kinds of ions with a mass-to-charge ratio (m/z) of 609, 610, and 611, respectively, each with a number of 100 for a total of 300, are placed in the center of the ion trap area, the RF voltage as described above is applied, and a dipole excitation signal AC is applied to the first electrode 101, the second electrode 102, the fifth electrode 105, and the sixth electrode 106 for ion excitation ejection. At this time, the movement center of the ions is biased toward the first electrode 101 and the second electrode 102, while the ions with m/z of 609 have been ejected out of the trap. The simulated mass spectrum peak obtained is shown in FIG.2, where there are three peaks, corresponding to ion peaks with m/z of 609, 610, and 611, the mass spectrum has a high and thin peak, and the half peak width (FWHM) is only 0.235, which proves that under the condition of unidirectional ion ejection, the octa-electrode triangular linear ion trap mass analyzer obtains a higher mass resolution and has good mass analysis performance.

The Second Embodiment

Figure 3:
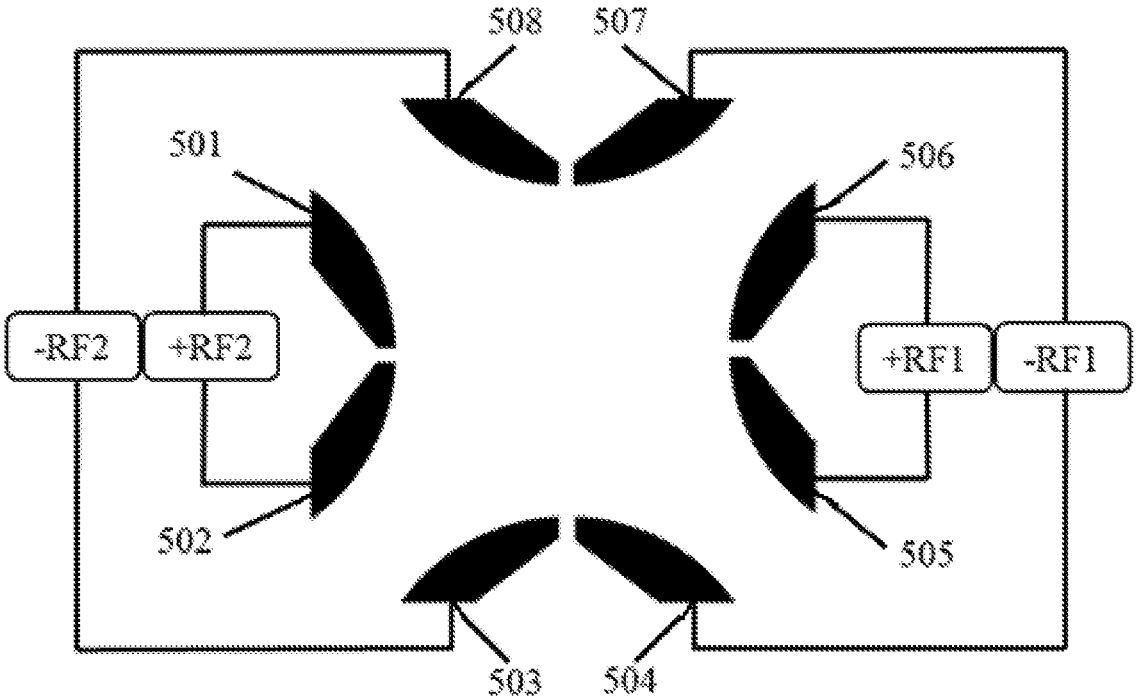
FIG. 3 is a schematic structural diagram of the second embodiment of the present disclosure.

As shown in FIG. 3, the eleventh electrode 501, the twelfth electrode 502, the thirteenth electrode 503, the fourteenth electrode 504, the fifteenth electrode 505, the sixteenth electrode 506, the seventeenth electrode 507, the eighteenth electrode 508 are arc electrodes. The entire linear ion trap is formed by eight surrounding arc electrodes. The RF voltage is applied in the manner shown in FIG. 3. As shown in FIG. 3, the RF voltage is applied as follows: the fifteenth electrode 505 and the sixteenth electrode 506 are applied with the first positive radio frequency signal +RF1, and the fourteenth electrode 504, the seventeenth electrode 507 are applied with the first negative radio frequency signal −RF1 of an equal amplitude and opposite phase, and the eleventh electrode 501, the twelfth electrode 502 are applied with a second positive radio frequency signal +RF2, and the thirteenth electrode 503 and the eighteenth electrode 508 are applied with a second negative radio frequency signal −RF2. During the experiment, by adjusting the amplitude of the second positive radio frequency signal +RF2, the electric field distribution inside the ion trap can be changed, and the movement trajectory and ejection direction of the ions can also be changed, similarly assuming RF2=(1−α) RF1. The purpose of this embodiment is also to change the electric field distribution inside the linear ion trap, and realize the unidirectional ejection of ions, by changing the application mode of the radio frequency voltage.

The difference between this embodiment and the first embodiment is that the way of applying the unbalanced RF voltage is different. The voltage amplitude applied to four of the eight electrodes is different from the other four. The electric field on the left of the linear ion trap is weaker than that on the right, the center of the electric field is biased toward the weaker side. Using this voltage application mode, unidirectional ejection of ions under boundary excitation conditions can be achieved. Simply scanning the amplitude of the RF voltage enables the ions to be ejected, instead of applying extra excitation voltage AC, which will reduce the size and power consumption of the RF power supply, and of great significance to the miniaturization of the mass spectrometer.

The Third Embodiment

Figure 4:
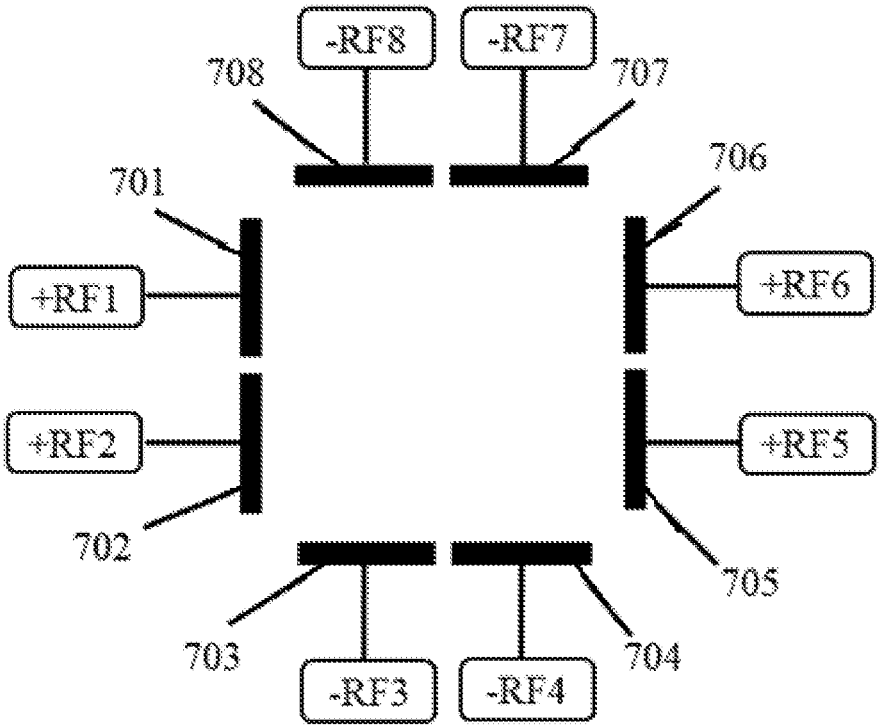
FIG. 4 is a schematic structural diagram of the third embodiment of the present disclosure.

As shown in FIG. 4, the twenty-first electrode 701, the twenty-second electrode 702, the twenty-third electrode 703, the twenty-fourth electrode 704, the twenty-fifth electrode 705, the twenty-sixth electrode 706, the twenty-seventh electrode 707 and the twenty-eighth electrode 708 are planar electrodes. The entire linear ion trap is formed by eight surrounding planar electrodes. The RF voltage is applied in the manner shown in FIG.4, and the RF voltage is applied as follows: the twenty-first electrode 701 is applied with the first positive radio frequency signal +RF1, the twenty-second electrode 702 is applied with the second positive radio frequency signal +RF2, and the twenty-third electrode 703 is applied with the third negative radio frequency signal −RF3, the twenty-fourth electrode 704 is applied with the fourth negative radio frequency signal −RF4, the twenty-fifth electrode 705 is applied with the fifth positive radio frequency signal +RF5, the twenty-sixth electrode 706 is applied with the sixth positive radio frequency signal +RF6, and the twenty-seventh electrode 707 is applied with the seventh negative radio frequency signal −RF7, and the twenty-eighth electrode 708 is applied with the eighth negative radio frequency signal −RF8.

The radio frequency signal in this embodiment can apply any voltage value, and the applied radio frequency voltage value can be optimized by the electric field calculation software, to finally obtain a comparatively perfect quadrupole field. Besides, combinations of voltages with different values can be selected according to the requirements under different situations, to achieve certain functions. The embodiment is advantageous in that the radio frequency voltage applied to each electrode can be adjusted as desired, thus the radio frequency voltage can be applied flexibly and conveniently, and highly adjustable.

The specific embodiments of the present disclosure have been described above. It should be understood that the present disclosure is not limited to the above specific embodiments, and those skilled in the art may make various variations or modifications within the scope of the appended claims, which does not affect the essence of the present disclosure.

What is claimed is:

1. An octa-electrode linear ion trap mass analyzer, comprising eight elongated electrodes and at least two end-cap electrodes, wherein in a cross section of each of the eight cylindrical electrodes, an outer side of the cross section has a approximately circular shape, and an inner side of the cross section toward an inner space of the octa-electrode linear ion trap mass analyzer comprises a protrusion extending towards the center of the octa-electrode linear ion trap;

a material of the octa-electrode linear ion trap mass analyzer is a conductive metal material or an insulating material plated with a conductive coating;

the eight elongated electrodes are divided into four groups of elongated electrodes, each group of the four groups of elongated electrodes comprises two elongated electrodes, and each two groups of the four groups of elongated electrodes are parallelly placed;

at least one through hole is provided in a center of each electrode of the end-cap electrodes;

the end-cap electrodes are respectively arranged at both ends of the eight elongated electrodes; and a slit is provided between the protrusions of at least one of the four groups of elongated electrodes.

2. The octa-electrode linear ion trap mass analyzer according to claim 1, wherein each of the end-cap electrodes is applied with a DC signal to form an axial bound field, and each elongated electrode of the eight elongated electrodes is applied with a radio frequency voltage to form a radial bound field.

3. The octa-electrode linear ion trap mass analyzer according to claim 1, comprising more than two end-cap electrodes, wherein a first end-cap electrode of the end-cap electrodes is located at a first end of a linear ion trap, wherein ions are injected from the first end, and the rest of the end-cap electrodes are arranged in order at a second end of the linear ion trap.

* * * * *